US006558037B2

(12) United States Patent
Gonella

(10) Patent No.: US 6,558,037 B2
(45) Date of Patent: May 6, 2003

(54) FLEXIBLE SELF-STANDING BAG

(75) Inventor: Federico Gonella, Milan (IT)

(73) Assignee: Evoluzione S.r.l., Milan (IT)

( * ) Notice: Subject to any disclaimer, the term of this patent is extended or adjusted under 35 U.S.C. 154(b) by 0 days.

(21) Appl. No.: 09/904,063

(22) Filed: Jul. 12, 2001

(65) Prior Publication Data

US 2002/0015539 A1 Feb. 7, 2002

(30) Foreign Application Priority Data

Jul. 27, 2000 (IT) ..... MI00A1723

(51) Int. Cl.[7] ..... B65D 33/06

(52) U.S. Cl. ..... 383/20; 383/104; 383/119; 220/9.1

(58) Field of Search ..... 383/20, 95, 104, 383/119, 19; 206/315.8; 220/9.1, 9.2, 9.3, 9.4

(56) References Cited

U.S. PATENT DOCUMENTS

| | | | | | |
|---|---|---|---|---|---|
| 526,566 | A | * | 9/1894 | Field | 383/20 |
| 754,811 | A | * | 3/1904 | Schlichter | 383/119 X |
| 1,648,162 | A | * | 11/1927 | Brauer | 206/315.8 |
| 1,658,243 | A | * | 2/1928 | Kindwall | 206/315.8 |
| 2,599,635 | A | * | 6/1952 | Hotze | 206/315.8 |
| 2,954,891 | A | * | 10/1960 | Imber | 383/20 |
| 4,901,885 | A | * | 2/1990 | Boots | 383/119 X |
| 5,158,369 | A | * | 10/1992 | Derby | 383/104 |
| 5,323,922 | A | * | 6/1994 | Lapoint et al. | 220/4.28 |
| 5,735,608 | A | * | 4/1998 | Branco | 383/104 X |
| 6,015,057 | A | * | 1/2000 | Stone et al. | 220/9.2 |
| 6,113,270 | A | * | 9/2000 | Hafer | 383/119 |
| 6,203,198 | B1 | * | 3/2001 | Stone | 220/9.2 |
| 6,220,755 | B1 | * | 4/2001 | Brown et al. | 383/119 X |
| 6,224,261 | B1 | * | 5/2001 | Stone | 220/9.2 |
| 6,244,443 | B1 | * | 6/2001 | Nickell et al. | 383/119 X |

* cited by examiner

*Primary Examiner*—Jes F. Pascua
(74) *Attorney, Agent, or Firm*—Akin, Gump, Strauss, Hauer & Feld, L.L.P.

(57) ABSTRACT

Self-standing bag, including a sack (1) of flexible material and a supporting structure for the sack (1). Said supporting structure for the sack (1) includes two stiffening members (4) of substantially rectangular shape, secured at opposite sides of the lateral wall of the sack (1) by means of at least two fastenings, one close to the bottom of the sack (1) and the other close to its top opening (2). A cover (7) consisting of a substantially tubular fabric member, preferably figured, is secured to the lateral wall of the sack (1) close to said top opening (2).

17 Claims, 1 Drawing Sheet

FLEXIBLE SELF-STANDING BAG

BACKGROUND OF THE INVENTION

The present invention relates to a flexible self-standing bag, i.e. a bag provided with a supporting structure suitable to support it, keeping it in a vertical position regardless of the fact that it be full or empty.

It is known that containers or bags intended, for example, to hold laundry or shopping items are preferably made of fabric or other flexible material. Such materials provide advantages as to resistance, lightness and practicality.

However, due to the flexibility of the materials they are made of, said bags collapse to the ground when they are empty, whereby they have to be always held by the handles or hung from a hook to keep them in the vertical position, with their opening facing upward.

There are known various types of bags provided with a supporting structure suitable to keep them in a vertical position even when they are empty. Such supporting structures usually consist of a rigid frame, e.g. metal frame, necessarily provided with a certain number of hinges to allow the folding of the bag when not in use. However, the costs for manufacturing said supporting structures and consequently the bags including them are quite high. Moreover, said supporting structures usually have a significant weight.

BRIEF SUMMARY OF THE INVENTION

Therefore the object of the present invention is to provide a bag of fabric or other flexible material which is free from said drawbacks. This object is achieved by means of a bag whose main characteristics are disclosed in the first claim and other features are disclosed in the dependent claims.

A first advantage of the bag according to the present invention is that its supporting structure consists of only two simple separate supporting members, whereby its manufacturing does not require the use of hinges or other connecting elements. As a consequence, the manufacturing cost of the bag including such a supporting structure is very low.

Another advantage of the bag according to the present invention is that it can be folded, so as to reduce its bulkiness when not in use.

BRIEF DESCRIPTION OF THE SEVERAL VIEWS OF THE DRAWING

Further advantages and characteristics of the bag according to the present invention will be clear to those skilled in the art from the following detailed description of an embodiment thereof, with reference to the only FIG. 1 showing a perspective view of the bag according to said embodiment, wherein the external cover has been partially removed.

DETAILED DESCRIPTION OF THE INVENTION

Figure 1:
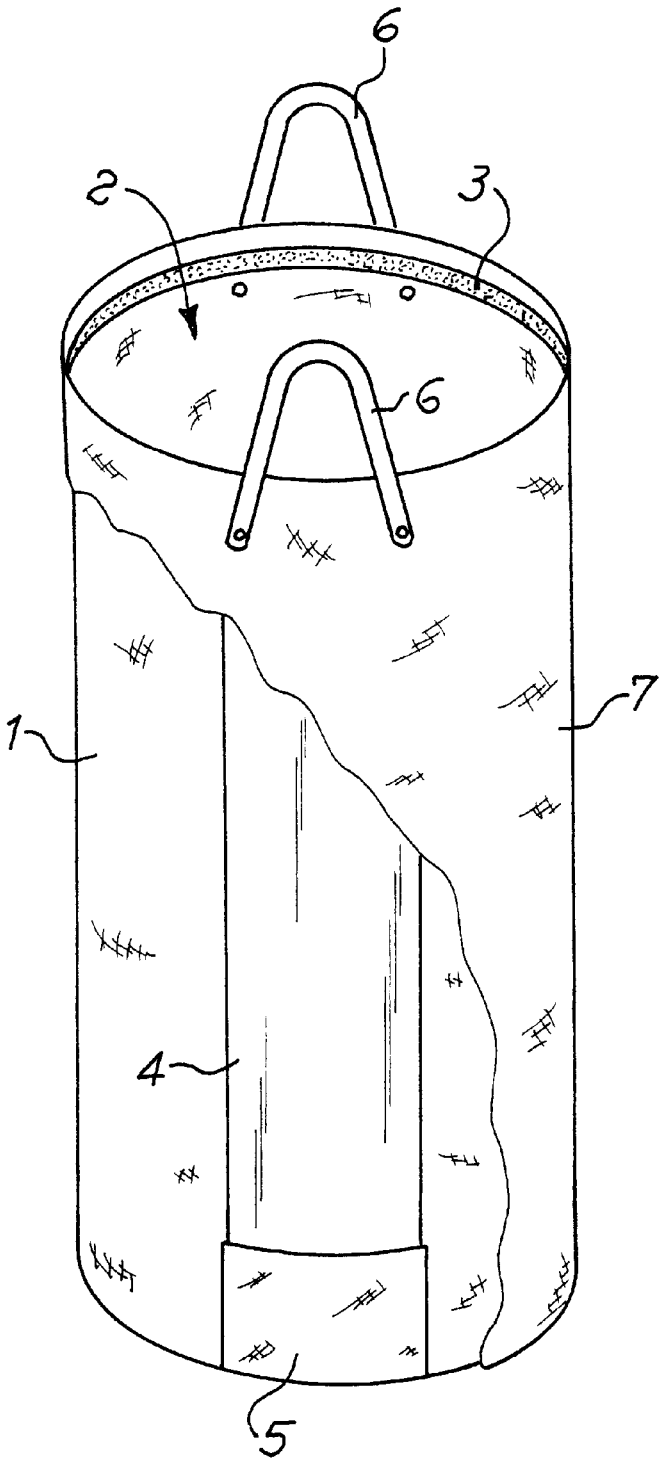

With reference to said figure, there is seen that the bag according to the present embodiment of the invention includes a sack 1, having a substantially cylindrical shape and provided with a circular bottom, a curved lateral wall and a top opening 2. However the shape of the bottom of sack 1 is not critical, and in other embodiments said bottom may have different shapes, e.g. elliptical, rectangular or polygonal. Said sack may be made of any flexible material, e.g. a fabric of natural or synthetic fibers. The top opening 2 of said sack 1 is provided with a closure device 3, such as for example Velcro-type bands or a zip.

To said lateral wall of sack 1 there are secured two stiffening members 4, of which only one is visible in the drawing, while the other one is located on the opposite side of said lateral wall, i.e., in the embodiment depicted in the figure, at the diametrically opposite position of the circular sack bottom. These stiffening members 4 consist of rectangular boards of rigid material, e.g. ligno-cellulosic cardboards or plastic materials, with a very small thickness and having a size equal to the height of sack 1. However, in other embodiments said stiffening members 4 could be made as rectangular frames, hollow inside.

The bottom end of each stiffening member 4 is slipped into a pocket 5 arranged on the outside of the lateral wall of sack 1, close to the bottom. The top end of each stiffening member 4 is secured to the sack lateral wall, close to the top opening 2, by means of two bolts.

The same bolts may also be used for securing to sack 1, close to its top opening 2, two handles 6 and a cover 7, having a merely esthetical function. Said cover 7, which the drawing shows in part, consists of a substantially tubular fabric, preferably figured, and may be further secured to sack 1, e.g. by sewing.

In other embodiments of the present invention the securing of the stiffening members 4 to the lateral wall of sack 1 may be achieved in a way different from the one illustrated above, e.g. by using bolts both at the top end and bottom end.

Possible additions and/or modifications may be made to the above-described and illustrated embodiment yet within the scope of the invention. In particular, the dimensional ratio between the height and width of the bag may be different from the ratio illustrated in the figure.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A self-standing bag, comprising:

a sack constructed of flexible material, said sack being provided with a bottom, a lateral wall extending from the bottom, and a top opening at an upper end of the lateral wall; and a supporting structure for the sack including first and second stiffening members of substantially rectangular shape, said stiffening members being secured at opposite sides of said lateral wall by upper and lower fastening arrangements proximal said top opening and said bottom, respectively, said lower fastening arrangement of each stiffening member comprising first and second pockets arranged on the lateral wall of the sack adjacent the bottom, with a lower end of the first and second stiffening members terminating in the first and second pockets, respectively, wherein the upper fastening arrangement of each stiffening member comprises fastening bolts extending through the stiffening members and the lateral wall.

2. A self-standing bag according to claim 1, and further comprising first and second handles positioned on the first and second stiffening members, respectively, said fastening bolts also extending through said handles for securing said handles to the sack.

3. A self-standing bag according to claim 1, wherein the top opening of said sack is provided with a closure device.

4. A self-standing bag according to claim 1, wherein said bottom of the sack has a circular shape.

5. A self-standing bag according to claim 1, and further comprising a cover of a substantially tubular form, the cover being secured to the lateral wall of the sack proximal the top opening.

6. A self-standing bag according to claim 5, wherein said sack and said cover are constructed of fabric of natural or synthetic fibers.

7. A self-standing bag according to claim 1, wherein said first and second stiffening members comprise boards of plastic material or ligno-cellulosic cardboard.

8. A self-standing bag, comprising:

a sack constructed of a flexible material, the sack having a bottom, a lateral wall extending from the bottom, a top opening at an upper end of the lateral wall, and first and second pockets arranged on opposite sides of the lateral wall proximal the bottom;

a supporting structure including first and second stiffening members, said first and second stiffening members having a lower end that is terminated in said first and second pockets, respectively, and an upper end that is secured to the lateral wall proximal the opening with fasteners that extend through the stiffening members and the lateral wall; and first and second handles connected to the first and second stiffening members, respectively.

9. A self-standing bag according to claim 8, wherein each handle has opposite ends connected to its respective stiffening member and a loop portion extending between the opposite ends and projecting above the sack.

10. A self-standing bag according to claim 9, wherein the fasteners extend through the opposite ends of the first and second handles to thereby secure the first and second handles to the first and second stiffening members, respectively.

11. A self-standing bag according to claim 10, and further comprising a cover member encircling the sack, the cover member being secured to the lateral wall of the sack proximal the top opening.

12. A self-standing bag according to claim 11, wherein the cover member is positioned between the first and second handles and the sack.

13. A self-standing bag according to claim 12, wherein the fasteners extend through the cover member.

14. A self-standing bag according to claim 8 comprising:

a sack constructed of a flexible material, the sack having a bottom, a lateral wall extending from the bottom, a top opening at an upper end of the lateral wall, and first and second pockets arranged on opposite sides of the lateral wall proximal the bottom;

a supporting structure including first and second stiffening members, said first and second stiffening members having a lower end that is terminated in said first and second pockets, respectively, and an upper end that is secured to the lateral wall proximal the opening with fasteners that extend through the stiffening members and the lateral wall; and further comprising a cover member encircling the sack, the cover member being secured to the lateral wall of the sack proximal the top opening.

15. A self-standing bag according to claim 14, wherein the fasteners extend through the cover member.

16. A self-standing bag according to claim 15, wherein a lower end of the cover member is free of the sack.

17. A self-standing bag according to claim 14, wherein a lower end of the cover member is free of the sack.

* * * * *